United States Patent [19]

Yoshii et al.

[11] Patent Number: 4,477,239

[45] Date of Patent: Oct. 16, 1984

[54] SCROLL TYPE FLUID DISPLACEMENT APPARATUS WITH OFFSET WRAPS FOR REDUCED HOUSING DIAMETER

[75] Inventors: Yuji Yoshii, Shimonojo; Masaharu Hiraga, Honjo, both of Japan

[73] Assignee: Sanden Corporation, Gunma, Japan

[21] Appl. No.: 433,896

[22] Filed: Oct. 12, 1982

[51] Int. Cl.[3] ..... F01C 1/02; F01C 17/06

[52] U.S. Cl. ..... 418/55

[58] Field of Search ..... 418/55

[56] References Cited

U.S. PATENT DOCUMENTS

| | | | |
|---|---|---|---|
| 801,182 | 10/1905 | Creux | 418/55 |
| 4,303,379 | 12/1981 | Hiraga et al. | 418/55 |
| 4,304,535 | 12/1981 | Terauchi | 418/55 |

*Primary Examiner*—John J. Vrablik

*Attorney, Agent, or Firm*—Banner, Birch, McKie & Beckett

[57] ABSTRACT

A scroll type fluid displacement apparatus including a housing with a fluid inlet port and fluid outlet port is disclosed. A fixed scroll is joined with the housing and has a first circular end plate from which a first wrap extends. An orbiting scroll has a second circular end plate from which a second wrap extends. The first and second wraps interfit at an angular and radial offset to make a plurality of line contacts to define at least one pair of sealed off fluid pockets. A driving mechanism, which includes a drive shaft, is operatively connected to the orbiting scroll to effect the orbital motion of the orbiting scroll at radius Ror, while the rotation of the orbiting scroll is prevented by a rotation preventing/-thrust bearing device, whereby the fluid in the fluid pockets moves inwardly or outwardly and changes in volume. The center of the first circular end plate is aligned with the center line of the housing and the center of the first wrap is radially offset from the center of the first circular end plate by the distance ½ Ror. The center of the second wrap is radially offset from the center of the second circular end plate by the distance ½ Ror. The drive shaft has a center line, which is aligned with the center line of the housing, and also has a crank pin, the center line of which is aligned with the center of the second circular end plate.

3 Claims, 13 Drawing Figures

SCROLL TYPE FLUID DISPLACEMENT APPARATUS WITH OFFSET WRAPS FOR REDUCED HOUSING DIAMETER

BACKGROUND OF THE INVENTION

This invention relates to a fluid displacement apparatus, and more particularly to a scroll type fluid displacement apparatus.

Scroll type fluid displacement apparatus are well known in the prior art. For example, U.S. Pat. No. 801,182 (Creux) discloses a device including two scroll members each having a circular end plate and a spiroidal or involute spiral element. These scroll members are maintained angularly and radially offset so that both spiral elements interfit to make a plurality of line contacts between their spiral curved surfaces to thereby seal off and define at least a pair of fluid pockets. The relative orbital motion of the two scroll members shifts the line contacts along the spiral curved surfaces and, therefore, the fluid pockets change in volume. Since the volume of the fluid pockets increases or decreases dependent on the direction of the orbital motion, the scroll type fluid displacement apparatus is applicable to compress, expand or pump fluids.

Referring to FIGS. 1*a*–1*d*, the principle of operation of scroll type fluid apparatus, particularly the compression operation, will be described.

FIGS. 1*a*–1*d* may be considered end views of a compressor wherein the end plates are removed and only spiral elements are shown at orbital angular positions spaced 90° from one another. Two spiral elements 1 and 2 are angularly offset and interfitted with one another. As shown in FIG. 1*a*, the orbiting spiral element 1 and fixed spiral element 2 make four line contacts as shown at four points A-D. A pair of fluid pockets 3*a* and 3*b* are defined between line contacts D, C and line contacts A, B as shown by the dotted regions. The fluid pockets are defined not only by the wall of spiral elements 1 and 2, but also by the end plates from which these spiral elements 1 and 2 extend.

Orbiting spiral element 1 is moved in relation to fixed spiral element 2 so that the center 0' of orbiting spiral element 1 revolves around the center 0 of fixed spiral element 2 at a radius of 0–0', while the rotation of orbiting spiral element 1 is prevented. This motion angularly and radially shifts fluid pockets 3*a* and 3*b* toward the center of the interfitted spiral elements, to gradually reduce the volume of each fluid pocket 3*a* and 3*b*, as shown in FIG. 1*a*–1*d*, thereby, compressing the fluid in each pocket.

In typical operation, fluid pockets 3*a*, 3*b* are initially formed when the ends of spiral elements 1,2 contact with the outer surface of the other spiral elements, as shown in FIG. 1*a*. Further rotation of orbiting spiral element 1 causes the pockets 3*a*, 3*b* to reduce in volume, as shown in FIGS. 1*b*, 1*c*. Thereafter, the pair of fluid pockets 3*a*, 3*b* become connected to one another, as shown in FIG. 1*d*, and the single pocket is further reduced in volume, as shown by the undotted central area in FIGS. 1*a*, 1*b* and 1*c*. During the reduction in volume of pockets 3*a*, 3*b*, the ends of the spiral elements leave contact with the outer surface of the other spiral elements, as shown in FIGS. 1*b*, 1*c*, 1*d*, until contact is reestablished, as shown in FIG. 1*a* to form a new pair of fluid pockets 3*a*, 3*b*.

This operation results in compression of the fluid in the pockets, since circular end plates are affixed to the axial facing ends of spiral elements 1 and 2. Discharge of the compressed fluid occurs through a centrally located discharge port in one of the end plates, shown diagrammatically as 4 in FIGS. 1*a*, 1*b* and 1*c*.

In comparison with conventional fluid displacement apparatus of the piston type, a scroll type fluid displacement apparatus has several advantages, such as continuous transfer of the fluid, volume efficiency, and relatively silent operation.

However, in order to increase the compressive capacity and compression ratio, the number of turns, or revolutions of each spiral element must be increased. Consequently the diameter of the apparatus also must be increased. This becomes a problem in a scroll type fluid displacement apparatus which is used as a refrigerant compressor of an automotive air conditioner, because the diameter of compressor housing must be kept as small as possible in order to fit the compressor within the typically very narrow space of an engine compartment. Furthermore, both scroll members must be maintained angularly and radially offset, and the dimensional accuracy of the compressor parts must be maintained, or the total dimensional error of the assembled compressor parts must be minimized in order to assure the stability and efficiency of the apparatus.

A cylindrical housing is an advantageous configuration for containing a pair of scroll members each of which have a wall thickness t and outermost angle $\phi$ of the center line of the scroll wall. An optimal disposition of the end plate and spiral element to reduce the diameter of the housing is disclosed in U.S. Pat. No. 4,304,535 (Terauchi), the disclosure of which is incorporated herein. Accordingly, as shown in FIGS. 2 and 3 herein, orbiting scroll 23' orbits at radius Ror while maintaining its angular orientation with fixed scroll 22'. The sectional area of the housing needed to permit the orbital motion of orbiting scroll 23' at radius Ror will be determined by the spiral or snail shaped area occupied by fixed spiral element 222' (area D in FIG. 3) and the space (area B in FIG. 3) over which orbiting spiral element 232' is swept. Therefore, the inner diameter of the cylindrical housing in which the pair of scrolls are contained will be given by $2\phi rg+t+Ror$, where rg is involute generating circle radius. In this construction, the center of inner wall of cylindrical housing is radially offset from the center of involute generating circle of fixed spiral element 222' also the maximum diameter of orbiting end plate 231' to permit the orbital motion within the above cylindrical housing will be given by $2\phi rg+t-Ror$.

A suitable drive point of the orbiting scroll is the involute generating circle center of the orbiting spiral element, since the relation between the center of tangential gas force in the fluid pockets defined by both spiral elements and the drive point does not change at any rotational angle of the drive shaft. Accordingly, it is considered to be a normal design criteria to locate, as shown, in FIG. 2 the center of drive shaft Os at the same point as the involute generating circle center $O_F$ of fixed spiral element 222', as a result the drive point $O_D$ of orbiting scroll 231' is automatically disposed on the involute generating circle center Oo of orbiting spiral element 232'. Orbiting scroll 231' therefore revolves at a radius $O_F$–Oo.

FIG. 4 illustrates the conventional relationship between the center of each end plate and the centers of the involute generating circles of the spiral elements. In this figure, the center $O_E$ of orbiting end plate 231' is radially offset from the involute generating circle center Oo of orbiting spiral element 232' to the right by a distance ½ Ror. Also, the center Oc of fixed end plate 221', i.e., the center of the compressor housing is radially offset from the involute generating circle center $O_F$ of fixed spiral element 222' to the right by a distance ½ Ror. The center Oc is also radially offset from the center Oo by a distance ½ Ror. The drive point $O_D$ is disposed on the center Oo and the center Os of drive shaft 13 is concentric with center $O_F$, whereby the orbital motion of the orbiting scroll 23' is shown as the locus of the center Oo. The locus of the center Oo is shown in FIG. 4 by the circle C with its center at center $O_s$ of drive shaft 13'.

FIG. 5 is a vertical sectional view of a scroll type compressor which utilizes the above mentioned disposition of scroll members. In this construction, the center $O_F$ of the drive shaft 13' is radially offset from the center Oc of housing 10' and also the center Oo of the drive point is radially offset from the center $O_E$ of orbiting end plate 231'. Therefore, a tubular boss 233' projecting axially from one end surface of end plate 231' and rotatably supported on a drive pin of the driving mechanism is radially offset from the center of end plate 231'. Since tubular boss 233', must be machined at an offset position, the machining process of orbiting scroll 23' is complicated, and hence, it is difficult to form the scroll with high accuracy in relation to the location of drive point and the scroll curve. Furthermore, a coupling mechanism 24' is required to maintain the angular relationship between both scrolls and to carry the tangential gas force from orbiting scroll 23'. However in this construction, the coupling mechanism, such as a ball coupling/-thrust bearing device 24', must be disposed within the housing 10' at a radially offset position. The stationary ring member 241' is fitted on the inner end surface of the housing 10' at a radially offset position, thereby a dead space A exists at the outer peripheral portion of ring member 241' when the ring member is formed by two concentric circles. Hence, the diameter of housing 10' should be increased, as shown in FIG. 5.

SUMMARY OF THE INVENTION

It is a primary object of this invention to provide an improvement in a scroll type fluid displacement apparatus wherein the diameter and weight of the housing of the apparatus are reduced.

It is another object of this invention to provide a scroll type fluid displacement apparatus wherein the relationship between the parts of the apparatus is precisely maintained and the consistency of performance in the mass production of the apparatus is improved.

It is still another object of this invention to provide a scroll type fluid displacement apparatus wherein the manufacturing technique and productivity of the parts of the apparatus are improved.

A scroll type fluid displacement apparatus according to this invention includes a housing having a fluid inlet port and fluid outlet port. A fixed scroll is joined with the housing and has a first circular end plate from which a first wrap extends. An orbiting scroll has a second circular end plate from which a second wrap extends. The first and second wraps interfit at an angular and radial offset to make a plurality of line contacts to define at least one pair of sealed off fluid pockets. A driving mechanism, which includes a drive shaft, is operatively connected to the orbiting scroll to effect the orbital motion of the orbiting scroll at radius Ror, while the rotation of the orbiting scroll is prevented by a rotation preventing/thrust bearing means, whereby the fluid in the fluid pockets moves inwardly or outwardly and changes in volume. The center of the first circular end plate is aligned with the center line of the housing and the center of the first wrap is radially offset from the center of the first circular end plate by the distance ½ Ror. The center of the second wrap is radially offset from the center of the second circular end plate by the distance ½ Ror. The drive shaft has a center line, which is aligned with the center line of the housing, and also has a crank pin, the center line of which is aligned with the center of the second circular end plate.

Further objects, features and aspects of this invention will be understood from the following detailed description of the preferred embodiment of this invention, referring to the annexed drawings.

DETAILED DESCRIPTION OF PREFERRED EMBODIMENT

Figure 6:
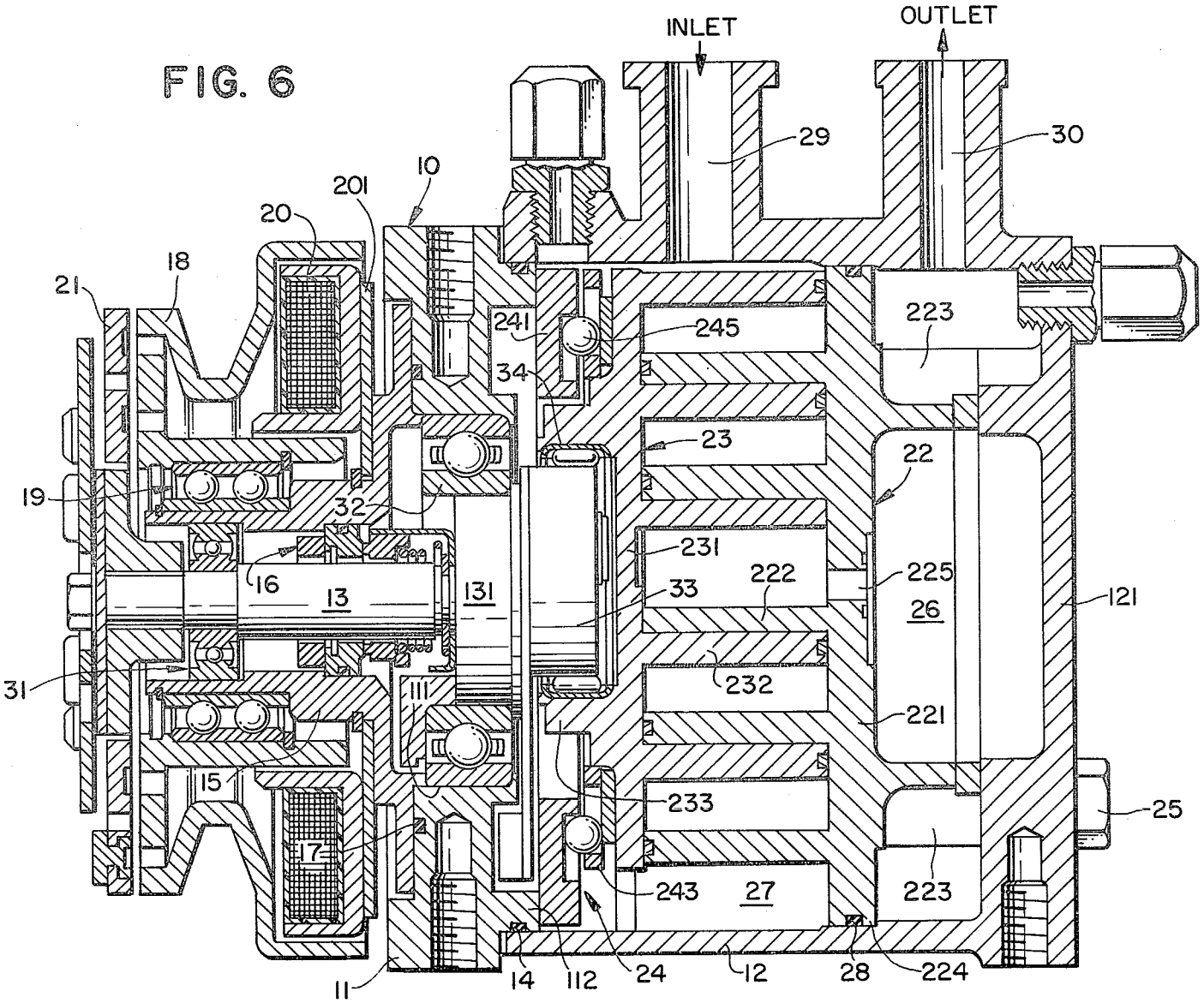
FIG. 6 is a vertical sectional view of a scroll type compressor according to one embodiment of this invention.

Referring to FIG. 6, a scroll type fluid displacement apparatus in accordance with the present invention, in particular, a scroll type compressor is shown. The compressor includes a compressor housing 10 having a front end plate 11 and a cup shaped casing 12 fastened to an end surface of front end plate 11. An opening 111, the center of which is concentric with the center line of cup shaped casing 12 is formed in the center of front end plate 11 for supporting a drive shaft 13. The center line of drive shaft 13 is thus concentric or aligned with the center line of cup shaped casing 12, i.e. with the center line of the housing. An annular projection 112, concentric with opening 111, is formed on the rear surface of front end plate 11 and faces cup shaped casing 12. An outer peripheral surface of annular projection 112 contacts an inner wall of the opening of cup shaped casing 12. Cup shaped casing 12 is fixed on the rear end surface of front end plate 11 by a fastening device, such as bolts and nuts (not shown), so that the opening of cup shaped casing 12 is covered by front end plate 11. An O-ring 14 is placed between the outer peripheral surface of annular projection 112 and the inner wall of cup shaped casing 12 to seal the mating surfaces between front end plate 11 and cup shaped casing 11.

Front end plate 11 has an annular sleeve 15 projecting from its front end surface. Sleeve 15 surrounds drive shaft 13 to define a shaft seal cavity. A shaft seal assembly 16 is assembled on drive shaft 13 within the shaft seal cavity. Sleeve 15 is attached to the front end surface of front end plate 11 by screws (not shown). An O-ring 17 is placed between the front end surface of front end plate 11 and an end surface of sleeve 15 to seal the mating surfaces of front end plate 11 and annular sleeve 15. Alternatively sleeve 15 may be formed integral with front end plate 11.

A pulley 18 is rotatably supported by a bearing 19 on the outer surface of sleeve 15. An electromagnetic coil 20, which is received in an annular cavity of pulley 18, is mounted on the outer surface of sleeve 15 by a support plate 201. An armature plate 21 is elastically supported on the outer end of drive shaft 13 which extends from sleeve 15. A magnetic clutch is formed by pulley 18, magnetic coil 20 and armature plate 21. Drive shaft 13 is thus driven by an external power source, for example, an engine of vehicle, through a rotation transmitting device, such as the above described magnetic clutch.

A number of elements are located within the inner chamber of cup shaped casing 12 including a fixed scroll 22, an orbiting scroll 23, a driving mechanism for orbiting scroll 23 and a rotation preventing/thrust bearing device 24 for orbiting scroll 23. The inner chamber of cup shaped casing 12 is formed between the inner wall of cup shaped casing 12 and the rear end surface of front end plate 11.

Fixed scroll 22 includes a circular end plate 221, and a wrap or spiral element 222 affixed to or extending from one end surface of end plate 221. A plurality of internal bosses 223 axially project from the end surface of end plate 221 on the side opposite spiral element 222. The center of spiral element 222 (the center of its involute generating circle) is radially offset from the center of end plate 221 by a distance Ror/2 wherein Ror is the radius at which orbiting scroll 23 orbits. The end surface of each boss 223 is seated on the inner surface of end plate portion 121 of cup shaped casing 12 and is fixed to end plate portion 121 by a plurality of bolts 25, one of which is shown in FIG. 6. Circular end plate 221 of fixed scroll 22 is fitted to the center surface of the casing to partition the inner chamber of cup shaped casing 12 into a discharge chamber 26 having bosses 223, and a suction chamber 27, in which spiral element 222 of fixed scroll 22 is located. A sealing member 28 is disposed within a circumferential groove 224 of circular end plate 221 to form a seal between the inner wall of cup shaped casing 12 and the outer wall of circular end plate 221.

Orbiting scroll 23, which is located in suction chamber 27, includes a circular end plate 231 and a wrap or spiral element 232 affixed to or extending from one end surface of end plate 231. The center of spiral element 232 (the center of its involute generating circle) is radially offset from the center of end plate 231 by a distance of Ror/2. The spiral elements 222 and 232 interfit at angular offset of 180° and predetermined radial offset. The spiral elements define at least a pair of fluid pockets between their interfitting surfaces. Orbiting scroll 23 is connected to the driving mechanism and rotation preventing/thrust bearing device 24 to effect the orbital motion at a circular radius Ror by the rotation of drive shaft 13 to thereby compress fluid passing through the compressor.

Generally, radius Ror of orbital motion is given by:

$$\frac{\text{(the pitch of the spiral element)} - 2\text{(the wall thickness of the spiral element)}}{2}$$

Figure 10:
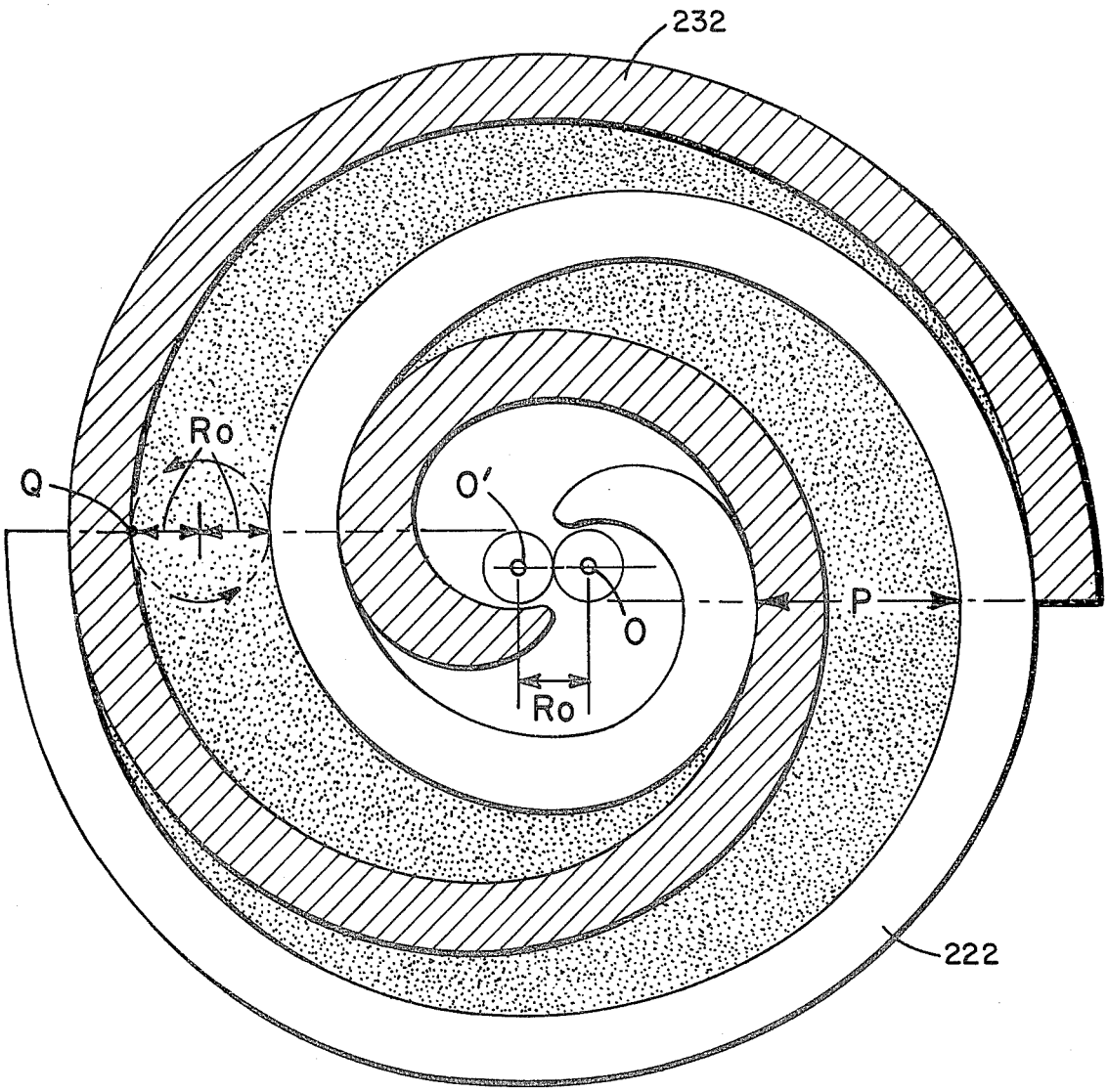
FIG. 10 is a diagrammatic sectional view illustrating the spiral elements of the fixed and orbiting scrolls.

As seen in FIG. 10, the pitch (p) of the spiral elements can be defined by $2\pi rg$, where rg is the involute generating circle radius. The radius Ror of orbital motion is also illustrated in FIG. 10, as a locus of an arbitrary point Q on orbiting scroll 23. The center of spiral element 232 is placed radially offset from the center of spiral element 222 by the distance Ror. Thereby, orbiting scroll 23 is allowed to undergo orbital motion at a radius Ror by the rotation of drive shaft 13. As orbiting scroll 23 orbits, line contacts between both spiral elements 222 and 232 shift to the center of the spiral elements along the surface of the spiral elements. The fluid pockets defined between spiral elements 222 and 232 move to the center of the spiral elements with consequent reduction of the volume, to thereby compress the fluid in the pockets. Fluid or refrigerant gas, introduced into suction chamber 27 through a fluid inlet port 29 on cup shaped casing 12, is taken into fluid pockets formed between both spiral elements 222 and 232 from outer end portion of both the spiral elements. As orbiting scroll 23 orbits, fluid in the fluid pockets is compressed and the compressed fluid is discharged into discharge chamber 26 from the fluid pocket at the spiral elements center through a hole 225, and therefrom, discharged through fluid outlet port 30 on cup shaped casing 12 to an external fluid circuit, for example, a cooling circuit.

Figure 7:
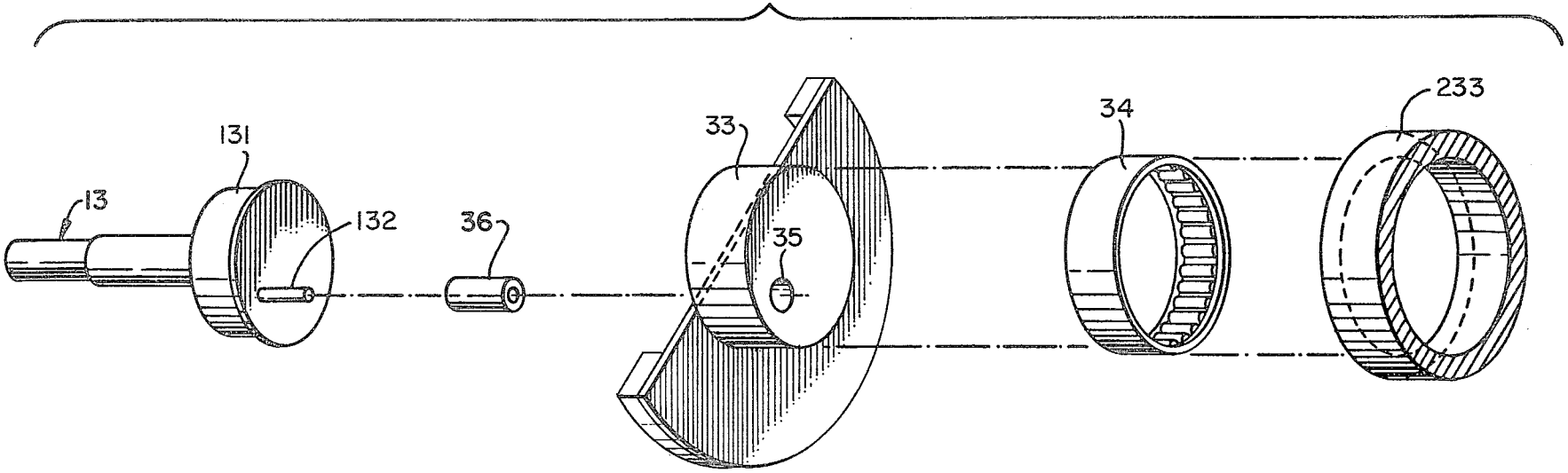
FIG. 7 is an exploded perspective view of the driving mechanism used in the compressor of FIG. 6.

Referring to FIG. 6 and FIG. 7, the driving mechanism of orbiting scroll 23 will be described. Drive shaft 13 is formed with a disk shaped rotor 131 at its inner end portion and is rotatably supported by sleeve 15 through a bearing 31 which is disposed within sleeve 15. Disk shaped rotor 131 is also rotatably supported by front end plate 11 through a bearing 32 located within opening 111 of front end plate 11. A crank pin or drive pin 132 projects axially from an axial end surface of disk shaped rotor 131 and is radially offset from the center of drive shaft 13. Circular end plate 231 of orbiting scroll 23 has tubular boss 233 axially projecting from the end surface opposite to the end surface from which spiral element 232 extends. A discoid or short axial bushing 33 fits into boss 233, and is rotatably supported therein by a bearing, such as needle bearing 34. An eccentric hole 35 is formed on bushing 33; eccentric hole 35 is radially offset from the center of bushing 33. Drive pin 132, with a sleeve or a bearing 36, fits into eccentric hole 35. Therefore, bushing 33 is driven by the revolution of drive pin 132 to thereby rotate within bearing 34. The spiral element 232 of orbiting scroll 23 is pushed against the spiral element 222 of fixed scroll 22 due to the moment created between the driving point and the reaction force acting point of the pressurized gas to secure the line contacts and effect radial sealing.

Figure 8:
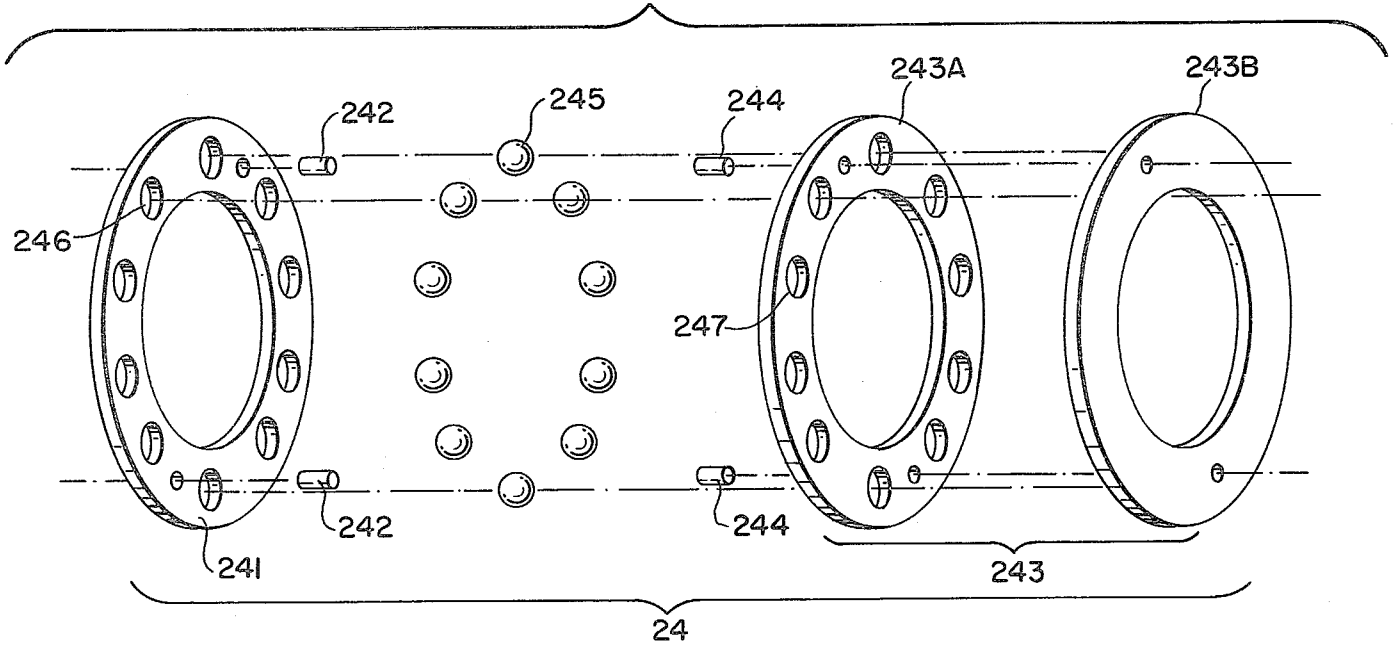
FIG. 8 is an exploded view of the rotation preventing/thrust bearing device used in the compressor of FIG. 6.

Referring to FIGS. 6 and 8, the rotation preventing/-thrust bearing device 24 will be described. Rotation preventing/thrust bearing device 24 is placed between the inner end surface of front end plate 11 and the end surface of circular end plate 231 which faces the inner end surface of front end plate 11. Rotation preventing/-thrust bearing device 24 includes a fixed ring 241, which is fastened against the inner end surface of front end plate 11 by a fastening device, such as pins 242, an orbiting ring 243 which is fastened against the end surface of circular end plate 231 by a fastening device, such as pins 244, and a bearing element, such as a plurality of spherical balls 245. Both rings 241 and 243 have a plurality of circular indentations 246 and 247 and spherical ball 245 is retained between each of these indentations 246 and 247. The rotation of orbiting scroll 23 is prevented by balls 245, which interact with the edges of indentations 246 and 247 to prevent rotation. Also, balls 245 carry the axial thrust load from orbiting scroll 23. Therefore, orbiting scroll 23 orbits while maintaining its angular orientation to fixed scroll 22. As shown in FIG. 8, orbiting ring 243 preferably consists of a ring member 243A and plate member 243B. Both members 243A and B are fastened against end plate 231 of orbiting scroll 23 by pins 244. Alternatively, orbiting ring 243 may be formed of a single integral piece of material like the fixed ring 241. The fixed ring 241 also can be formed of two ring shaped pieces like the orbiting ring.

Figure 1A:
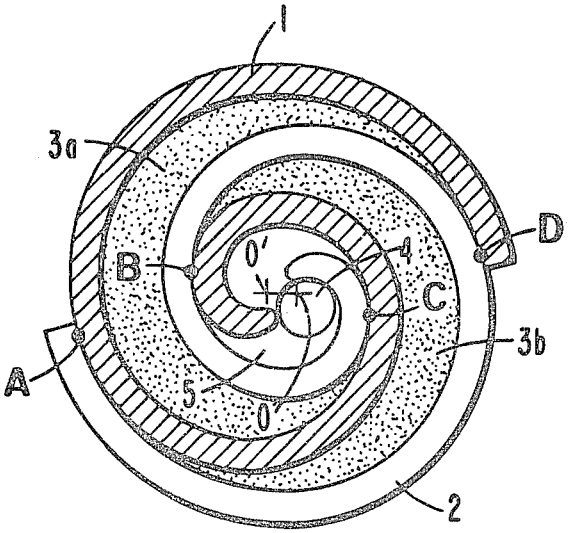
FIGS. 1*a*–1*d* are schematic views illustrating the relative movement of interfitting spiral elements to compress fluid.
Figure 1B:
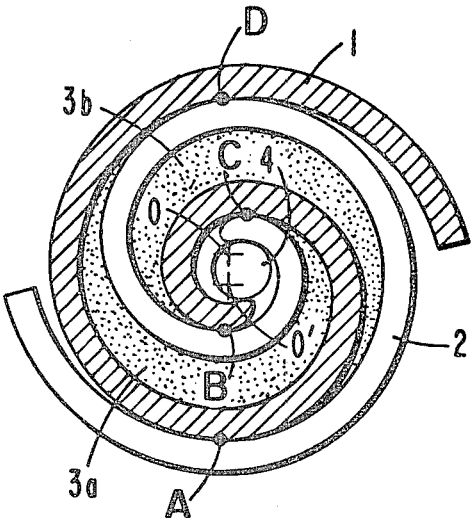
Figure 1C:
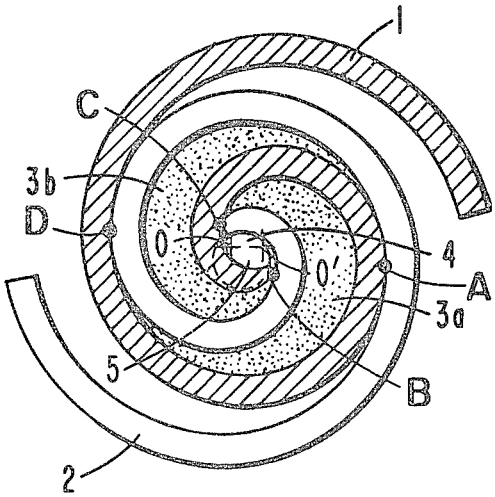
Figure 1D:
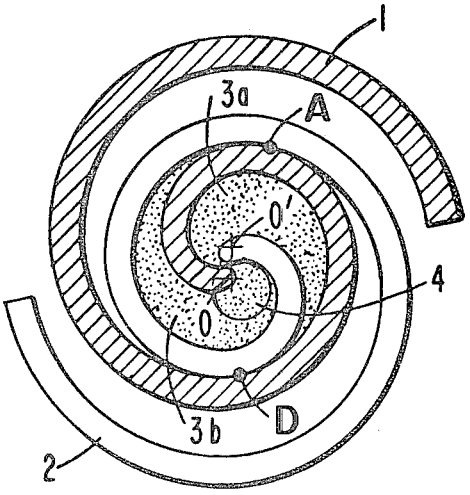
Figure 2:
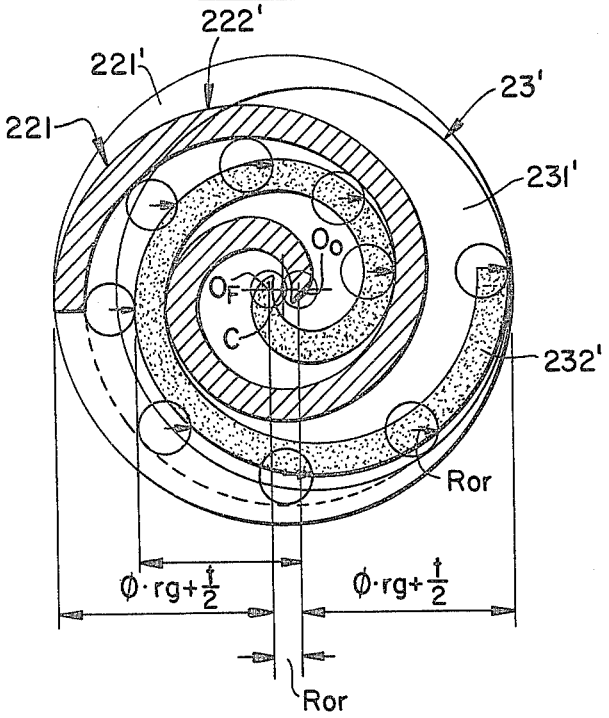
FIG. 2 PRIOR ART
FIG. 2 is a schematic view illustrating the dimensional relationship between the cylindrical compressor housing and the end plate of an orbiting scroll in known compressor.
Figure 3:
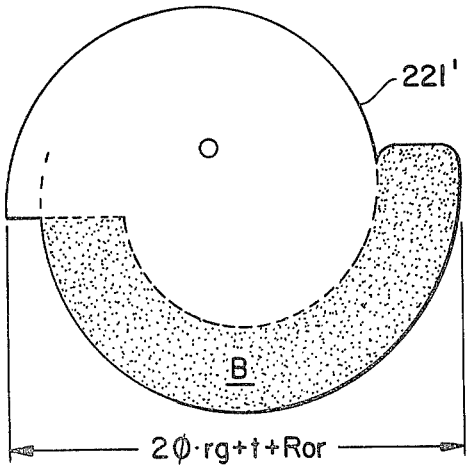
FIG. 3 PRIOR ART
FIG. 3 is a schematic view of the space occupied by the scroll wraps used in the compressor of FIG. 2, illustrating its dimensional requirements.
Figure 4:
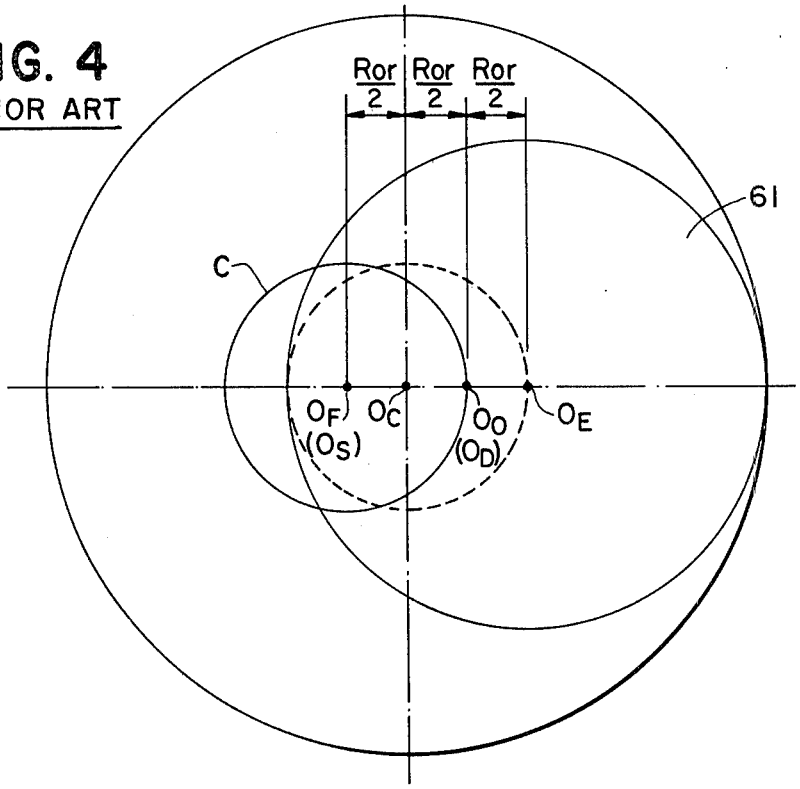
FIG. 4 PRIOR ART
FIG. 4 is a schematic view illustrating the relative location of the centers of involute for orbiting and, fixed scrolls drive point and shaft center in the known compressor.
Figure 9:
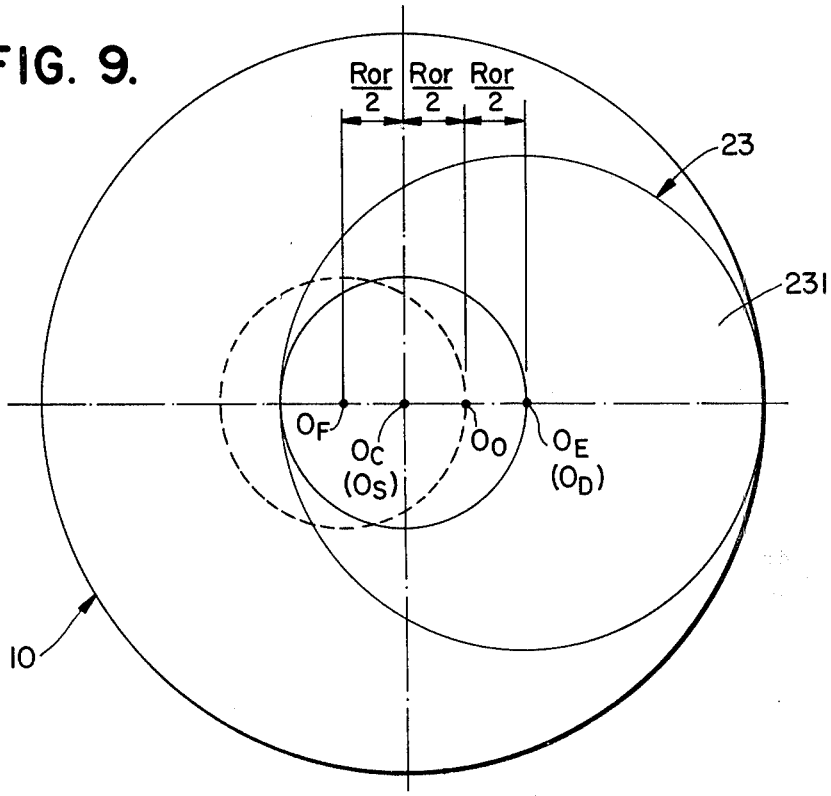
FIG. 9 is a schematic view illustrating the relative location of the centers of involute for the scrolls, drive point and shaft center in the compressor of FIG. 6.

The relative locations of the centers of the involute for the spiral elements 222 and 232, and centers of circular end plates 221 and 231, housing 10, drive shaft 13 and drive pin 132, in accordance with the present invention, are illustrated in FIG. 9. As seen therein, the center Oc of the end plate 221 of fixed scroll 22 is concentric or aligned with the center line $O_S$ of the drive shaft 13, which is also the center line of housing 10. The drive point $O_D$ of orbiting scroll 23 is placed on the center $O_E$ of the end plate 231 of orbiting scroll 23. Therefore, annular boss 233 which projects axially from the axial end surface of end plate 231 of orbiting scroll 23 to operatively connect it to the driving mechanism can be formed concentric with end plate 231 of orbiting scroll 23, and the ring element 241 of rotation preventing/-thrust bearing device 24 can be located on the end surface of the housing concentric with the center of the housing.

Figure 5:
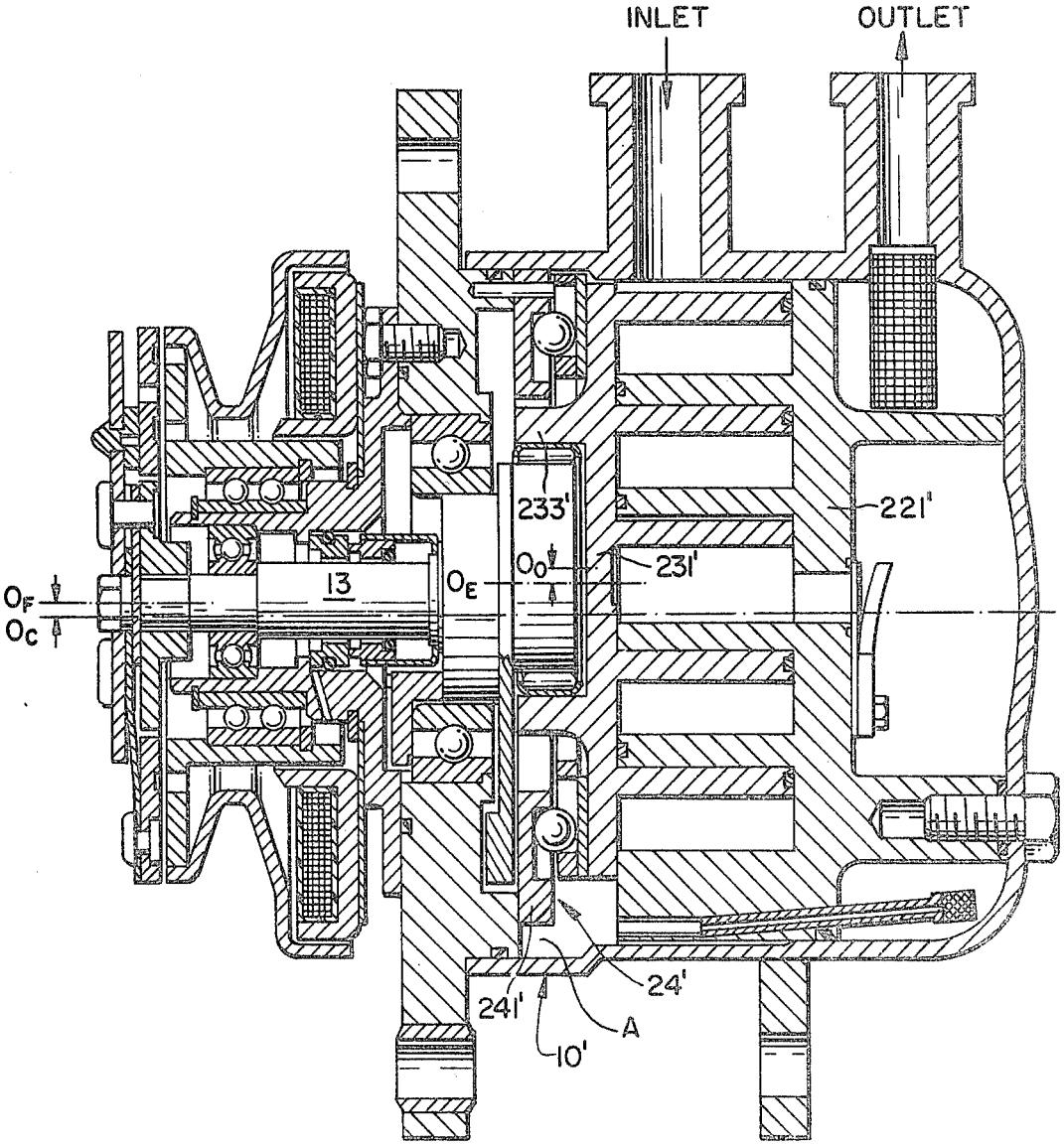
FIG. 5 PRIOR ART
FIG. 5 is a vertical sectional view of the scroll type compressor using the relationship of FIG. 4.

The dead space which is caused by the eccentric disposition (shown as A in FIG. 5) of the ball coupling/-thrust bearing mechanism can be eliminated and the diameter of the housing at its front portion can be reduced. Since, the disposition of the driving mechanism or the rotation preventing/thrust bearing devices is concentric to the connected parts, the manufacturing of the parts, for example the orbiting scroll and the front end plate, can be done by simple working of the parts to a high dimensional accuracy. Furthermore, the assembly of the apparatus utilizing such concentric parts is simple.

This invention has been described in detail in connection with the preferred embodiment, but this is an example only and the invention is not restricted thereto. It will be easily understood by those skilled in the art that other variations and modifications can be easily made within the scope of the invention.

What is claimed is,

1. In a scroll type fluid displacement apparatus including a housing, a fluid inlet port and a fluid outlet port, a fixed scroll joined with said housing and having a first circular end plate from which a first wrap extends into the interior of said housing, an orbiting scroll having a second circular end plate from which a second wrap extends, said first and second wraps interfitting at an angular and radial offset to make a plurality of line contacts to define at least one pair of sealed off fluid pockets, a driving mechanism including a drive shaft operatively connected to said orbiting scroll to effect the orbital motion of said orbiting scroll at radius Ror, and a rotation preventing means for preventing the roation of said orbiting scroll so that the volume of the fluid pockets changes during the orbital motion of said orbiting scroll, the improvement comprising the center of said first wrap being radially offset from the center of said first circular end plate by the distance ½ Ror, the center of said second wrap being radially offset from the center of said second circular end plate by the distance ½ Ror, said drive shaft having a center line aligned with the center line of said housing and, said drive shaft having a crank portion at its inner end portion operatively connected to said orbiting scroll at the center of said second end plate.

2. The scroll type fluid displacement apparatus of claim 1 wherein said driving mechanism comprises said drive shaft which has said crank pin projecting axially from the inner end surface thereof and radially offset from the center line of said drive shaft, a tubular boss axially projecting from the axial end surface of said second end plate and, a bushing which is rotatably supported within said tubular boss and connected to said crank pin.

3. A scroll type fluid displacement apparatus comprising:

(a) a housing including a front end plate and a cup shaped casing fastened to one end surface of said front end plate and having a fluid inlet port and a fluid outlet port;

(b) a fixed scroll fixedly disposed within said cup shaped casing and having a first circular end plate from which a first wrap extends, the center of said first wrap being radially offset from the center of said first circular end plate by a distance ½ Ror, and said first circular end plate dividing the interior of said housing into a suction chamber and a discharge chamber;

(c) an orbiting scroll movably disposed within the suction chamber of said housing and having a second circular end plate from which a second wrap extends, the center of said second wrap being radially offset from the center of said second circular end plate by a distance ½ Ror, said first and second wraps interfitting at an angular and radial offset to make a plurality of line contacts to define at least one pair of sealed off fluid pockets;

(d) a driving mechanism including a drive shaft operatively connected to said orbiting scroll to effect the orbital motion of said orbiting scroll at the radius Ror while the rotation of said orbiting scroll prevented by a rotation preventing means;

(e) said drive shaft penetrating said front end plate to be rotatably supported thereby, and the center line of said drive shaft being aligned with the center line of said housing; and (f) a drive pin axially projecting from the inner end surface of said drive shaft and operatively connected to said orbiting scroll, the center line of said drive pin being aligned with the center of the second circular end plate of said orbiting scroll.

* * * * *

UNITED STATES PATENT AND TRADEMARK OFFICE

CERTIFICATE OF CORRECTION

PATENT NO. : 4,477,239

DATED : October 16, 1984

INVENTOR(S) : Yuji Yoshii et al.

It is certified that error appears in the above—identified patent and that said Letters Patent is hereby corrected as shown below:

Column 3, line 10, "13" should be —13'—.

Signed and Sealed this

*Sixteenth* Day of *April 1985*

[SEAL]

*Attest:*

DONALD J. QUIGG

*Attesting Officer*

*Acting Commissioner of Patents and Trademarks*